US009856681B1

(12) United States Patent
Sridhar et al.

(10) Patent No.: US 9,856,681 B1
(45) Date of Patent: Jan. 2, 2018

(54) PUSH LIFTER

(71) Applicant: NIFCO AMERICA CORP., Canal Winchester, OH (US)

(72) Inventors: Raghu Sridhar, Canal Winchester, OH (US); Taku Hirama, Canal Winchester, OH (US)

(73) Assignee: NIFCO AMERICA CORP., Canal Winchester, Ohaio ( * ) Notice: Subject to any disclaimer, the term of this patent is extended or adjusted under 35 U.S.C. 154(b) by 0 days.

(21) Appl. No.: 15/185,784

(22) Filed: Jun. 17, 2016

(51) Int. Cl.
*E05C 3/00* (2006.01)
*E05C 3/14* (2006.01)
*E05C 19/00* (2006.01)

(52) U.S. Cl.
CPC ..... *E05C 3/145* (2013.01); *E05C 19/009* (2013.01)

(58) Field of Classification Search
CPC ..... E05C 3/145; E05C 19/009; B60K 15/05
USPC ..... 296/97.22
See application file for complete search history.

(56) References Cited

U.S. PATENT DOCUMENTS 4,225,764 A * 9/1980 Buttner ..... H01H 17/165 200/518
5,178,265 A * 1/1993 Sepke ..... H01H 13/58 200/528
8,292,113 B2 * 10/2012 Nakaya ..... B60K 15/05 220/263
8,353,553 B2 1/2013 Beck
8,485,585 B2 7/2013 Taniguchi et al.
8,845,001 B2 * 9/2014 Kotama ..... B60L 11/1818 296/97.22
9,010,836 B2 * 4/2015 Watanabe ..... B60K 15/05 296/97.22
2009/0139991 A1 * 6/2009 Nakaya ..... B60K 15/05 220/315
2009/0307869 A1 * 12/2009 Salice ..... E05C 19/022 16/85
2011/0174102 A1 * 7/2011 Beck ..... B60K 15/05 74/110
2012/0167472 A1 * 7/2012 Taniguchi ..... B60K 15/05 49/386
2014/0042768 A1 * 2/2014 Watanabe ..... B60K 15/05 296/97.22
2016/0326780 A1 * 11/2016 Watanabe ..... E05B 83/34
2016/0348408 A1 * 12/2016 Watanabe ..... B60K 15/05
2016/0375762 A1 * 12/2016 Lee ..... B60K 15/05 296/97.22

* cited by examiner

*Primary Examiner* — Victor Macarthur
(74) *Attorney, Agent, or Firm* — Manabu Kanesaka

(57) ABSTRACT

A push lifter includes a body portion; a rod slidably disposed inside the body portion; an urging portion to urge the rod in a direction away from the body portion; and a rotator disposed rotatably about an axial of the rod at the one end of the body portion to lock or unlock the rod. The rod includes a first rib portion, and a second rib portion distanced from the first rib portion in an axial direction of the rod, to rotate the rotator. The rotator includes an inner cam portion so that when the rod is pressed to slide inwardly of the body portion, the first rib portion abuts against the inner cam portion to rotate the rotator, and when the rod is released to project outwardly from the body portion, the second rib portion abuts against the inner cam portion to rotate the rotator.

6 Claims, 8 Drawing Sheets

PUSH LIFTER

FIELD OF THE INVENTION

The present invention relates to an improvement of a push lifter attached to an auto vehicle for opening and closing a fuel lid of a fuel tank by a pushing operation.

BACKGROUND OF THE INVENTION

For an example of a conventional push-out device for a fuel lid, PTL 1 is referred to. In FIG. 9(*a*) of the present application, a cross-sectional view of a push-out device 10 of PTL 1 is shown. The push-out device 10 of PTL 1 includes a case 40 having one end fixed to an automobile, a cap 50 fixed on another end of the case 40, a rod 60 slidably held inside the case 40, a boot 100, an urging mechanism 90 to urge the rod 60 in a direction protruding from an inside of the case 40, and a rotator 70 rotatably disposed on the rod 60.

As shown in FIG. 9(*b*) of the present application, the rod 60 includes a cam portion 61, slide protrusions 65 protruding from an outer circumference of the cam portion 61, and a stationary side cam portion 64 on a lower surface of the cam portion 61. As shown in FIG. 9(*c*) of the present application, the rotator 70 includes a movable side cam portion 72 formed on an upper surface thereof and engagement protrusions 73 on an outer circumference thereof. As shown in FIG. 9(*d*), the cap 50 includes a cylinder portion 52 having slide grooves 55 to receive the slide protrusions 65 of the rod 60 and the engagement protrusions 73 of the rotator 70, and lock grooves 56 formed on a lower side of the slide grooves 55 to lock the rotator 70 non-rotatably.

The push-out device 10 of PTL 1 is structured so that when the fuel lid is in a closed state, the rod 60 is retracted into the case 40 and the engagement protrusions 73 of the rotator 70 are locked to the lock grooves 56 as shown in FIG. 9(*d*) of the present application. When the fuel lid in the closed state is pushed in, the rod 60 is pushed into the case 40 causing the rotator 70 to move along with the rod 60, the stationary side cam 64 and the movable side cam portion 72 disengage from each other, and the engagement protrusions 73 of the rotator 70 also simultaneously disengage from the lock grooves 56 as shown in FIG. 9(*e*) of the present application. When the rod 60 is released, the urging mechanism 90 urges the rod 60 toward the fuel lid. The stationary side cam 64 and the movable side cam portion 72 abut against each other to rotate the rotator 70 and the engagement protrusions 73 slide along the slide grooves 55 as shown in FIG. 9(*f*) of the present application. The rod 60 abuts against the fuel lid and the fuel lid is opened.

Conversely, when the fuel lid in the open state is pushed to close, the rod 60 is pushed into the case 40. The engagement protrusions 73 of the rotator 70 slide along and out of the slide grooves 55 as shown in FIG. 9(*e*) of the present application, and the stationary side cam 64 and the movable side cam portion 72 disengage from each other. When the rod 60 is released, the urging mechanism 90 urges the rod 60 toward the fuel lid. The stationary side cam 64 and the movable side cam portion 72 abut against each other to rotate the rotator 70, and the engagement protrusions 73 engage the lock grooves 56 as shown in FIG. 9(*d*) of the present application. The fuel lid is closed.

For another example of a conventional push-out device for a fuel lid, PTL 2 is referred to. In FIG. 10(*a*) of the present application, a cross-sectional view of a push-out device of PTL 2 is shown. The push-out device of PTL 2 includes a housing 10, a cover 14 fixed on another end of the housing 10, a flexible cap 60 mounted on the cover 14, a pushbar 20 slidably held inside the housing 10, a spring 22 to urge the pushbar 20 in a direction protruding from an inside of the housing 10, and a ring 36 rotatably disposed on the pushbar 20.

As shown in FIGS. 10(*a*), 10(*b*) of the present application, the pushbar 20 includes grooves 40 extending in an axial direction of the pushbar 20, rises 48 protruding from an outer circumferential surface of the pushbar 20 at a position above the grooves 40 in the axial direction, rises 52 protruding from the outer circumferential surface of the pushbar 20 and arranged between the rises 48 in a circumferential direction of the pushbar 20, and locking recesses 46 arranged between the grooves 40 in the circumferential direction and below the rise 52. As shown in FIG. 10(*c*) of the present application, the ring 36 is rotatably received in a cavity 18 of the housing 10. The ring includes protrusions 38 protruding from an inner circumferential surface of the ring 36.

The push-out device of PTL 2 is structured so that when the fuel lid is in a closed state, the pushbar 20 is retracted into the housing 10 and the protrusions 38 of the ring 36 are locked to the locking recesses 46. When the fuel lid in the closed state is pushed in, the pushbar 20 is pushed into the housing 10 and the protrusions 38 of the ring 36 disengage from the locking recesses 46 and slide along a surface of the rises 52. When the pushbar 20 is released, the spring 22 urges the pushbar 20 upward so that the protrusions 38 of the ring 36 slide along a surface between the grooves 40 in the circumferential direction and into the grooves 40. Then, the pushbar 20 slides upwardly toward the fuel lid to abut against the fuel lid and the fuel lid is opened.

Conversely, when the fuel lid in an open state is pushed to close, the pushbar 20 is pushed into the housing 10. The protrusions 38 of the ring 36 slide along the grooves 40 and slide along the surface of the rise 48. When the pushbar 20 is released, the spring 22 urges the pushbar 20 upward and the protrusions 38 of the ring 36 slide toward the locking recesses 46. The protrusions 38 are locked to the locking recesses 46 and the fuel lid is closed.

CITATION LIST

Patent Document

PTL 1: U.S. Pat. No. 8,485,585 B2
PTL 2: U.S. Pat. No. 8,353,553 B2

SUMMARY OF THE INVENTION

Problems to be Solved by the Invention

In a structure of the push-out device 10 in PTL 1, a loud sound of clicking occurs when the movable side cam portion 72 of the rotator 70 abuts against the stationary side cam 64 of the rod 60 after rotation. The level of sound depends on a spring force of the urging mechanism 90, which may be slightly reduced by applying grease between the stationary side cam 64 of the rod and the movable side cam portion 72 of the rotator 70; however, the sound still persists. Since the level of sound depends on the spring force of the urging mechanism 90, reducing the spring force of the urging mechanism 90 will reduce the level of sound. However, a predetermined amount of spring force is required to operate the lid in a cold or freezing environment. Therefore, reducing the spring force below the predetermined amount of the spring force will cause the lid to be inoperable in the cold or freezing environment.

Further, in a structure of the push-out device in PTL 2, the protrusions 38 of the ring 36 engage and disengage the grooves 40 and the locking recesses 46 to switch between a protruding position and housed position of the pushbar 20. The ring 36 is not urged by the spring 22 so that a loud sound is not generated during the movement of the pushbar 20. However, the size of the protrusions 38 of the ring 36 cannot be formed over a predetermined size, so when an external force in the radial direction is applied during the retraction of the pushbar 20, the protrusion 38 may receive the external force resulting in a breakage of the protrusion 38 from the ring 36.

Therefore, the present invention is made in view of the aforementioned problems that a conventional technology has, and an object of the present invention is to provide a push lifter with reduced level of sound when opening and closing the fuel lid while maintaining a predetermined amount of the spring force of the urging mechanism and increased strength of the engaging parts between the rod and the rotator.

Further objects and advantages of the present invention will be apparent from the following description of the present invention.

Means for Solving the Problems

In order to obtain the aforementioned object, in the present invention, a push lifter includes a body portion adapted to be fixed to a member; a rod slidably disposed inside the body portion and protruding from one end of the body portion, the rod having a first rib portion and a second rib portion distanced from the first rib portion in an axial direction of the rod; an urging portion disposed inside the body portion to urge the rod in a direction away from the body portion; and a rotator disposed rotatably about an axial of the rod at the one end of the body portion and including a plurality of teeth extending in the axial direction on an inner circumferential surface thereof and a plurality of connecting pieces disposed alternately between the teeth and extending in a circumferential direction of the rod to connect the plurality of teeth, the rod being locked when the second rib portion abuts against the connecting piece between the plurality of teeth. The plurality of teeth each includes a first end to abut against the first rib portion to rotate the rotator when the rod is pressed to slide inwardly of the body portion and a second end opposite to the first end to abut against the second rib portion to rotate the rotator when the rod is released to project outwardly from the body portion.

According to such configuration, the rod and the rotator are engaged to each other with increased reliability and performance. Further, the rotator is not urged by the urging portion so that a loud sound is not generated during the movement of the rod.

Another aspect of the present invention is that the second rib portion is positioned to deviate from the first rib portion in the circumferential direction so that when the rod is pressed to the body portion, the second rib portion slides along the rod away from a position between the plurality of teeth and the first rib portion slides along the rod to abut against the first end of teeth to rotate the rotator, and when the rod is released, the second rib portion slides toward the rotator to abut against the second end of the teeth, rotates the rotator, and slides between the plurality of teeth to abut against the connecting piece.

According to such configuration, the rotator is assured to rotate only when the first or second rib portion abuts against the plurality of teeth.

A further aspect of the present invention is that the first end of each of the plurality of teeth has an inclined surface, the first rib portion has an inclined surface on one end facing the rotator to abut against the first ends of the plurality of teeth to rotate the rotator in one rotational direction, the second end of each of the plurality of teeth has an inclined surface, and the second rib portion has an inclined surface on one end facing the rotator to abut against the second ends of the plurality of teeth to rotate the rotator in the one rotational direction.

According to such configuration, the rotator is ensured to rotate in one rotational direction.

A still further aspect of the present invention is that the push lifter further includes a cap portion mounted over the body portion to house the rotator; wherein when the rod is pressed to slide toward the body portion, the rotator is rotated to lock or unlock the rod while being retained between the cap portion and the body portion.

According to such configuration, the rotator is ensured to be supported rotatably and not slide in the axial direction along with the movement of the rod.

A still further aspect of the present invention is that the cap portion further comprises a pair of elastic pieces formed on a sidewall thereof extending in the circumferential direction and each having a tension leg at a free end thereof protruding toward the rotator to slide along an outer circumferential surface of the rotator, the tension leg urging the rotator radially inwardly to support the rotator in a radial direction.

According to such configuration, the rotator is prevented from overly rotating or rotating in a reverse rotational direction.

A still further aspect of the present invention is that the rod further comprises a flange portion disposed on a side opposite to the first rib portion with respect to the second rib portion, and having one surface facing the rotator and another surface opposite to the one surface to receive the urging portion thereunder.

According to such configuration, the rod effectively receives an urging force of the urging portion.

DETAILED DESCRIPTION OF THE EMBODIMENTS

Hereinafter, an embodiment for carrying out the invention is described based on FIGS. 1(*a*)-8(*e*). In an explanation, terms indicating the directions follow the directions shown by a direction key in FIG. 1(*a*). However, an arrangement of the push lifter according to the present embodiment is not limited to the aforementioned directions.

Figure 2A:
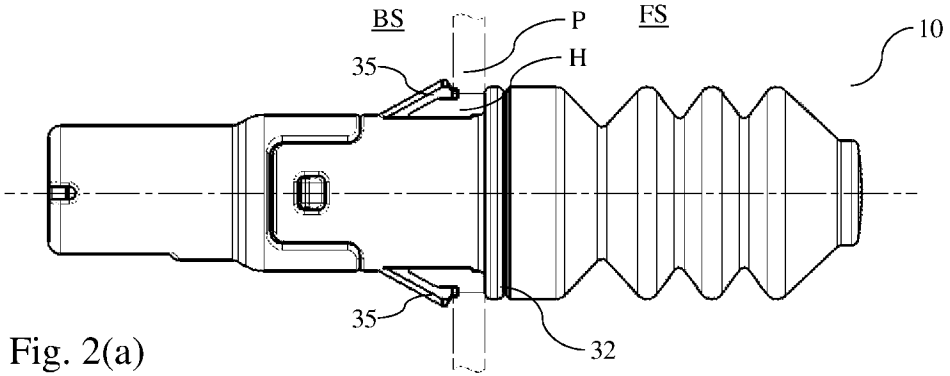
FIGS. 2(*a*), 2(*b*) illustrate the push lifter according to the present embodiment attached to an inner panel of the auto vehicle, wherein FIG. 2(*a*) is a front view thereof in a state in which a fuel lid is open, and FIG. 2(*b*) is a front view thereof in a state in which the fuel lid is closed.
Figure 2B:
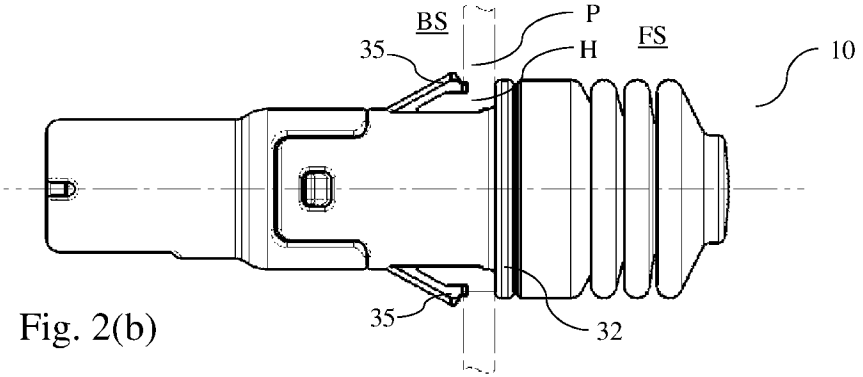

The push-up device 10 of the present embodiment is attached to, for example, an inner panel P of an auto vehicle facing a fuel lid so that when the user presses the fuel lid in a closed state as shown in FIG. 2(*b*), the push-up device 10 pushes out the fuel lid in an opening direction as shown in FIG. 2(*a*), and the user has access to the fuel tank to fuel the auto vehicle accordingly.

Figure 1B:
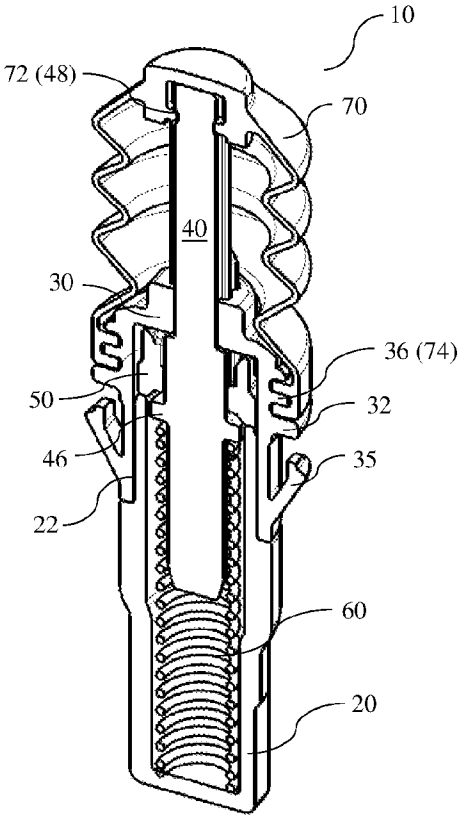
FIGS. 1(*a*), 1(*b*) illustrate a push lifter according to the present embodiment, wherein FIG. 1(*a*) is a perspective view thereof, and FIG. 1(*b*) is cross-sectional view thereof along plane 1(*b*)-1(*b*) of FIG. 1(*a*).
Figure 1A:
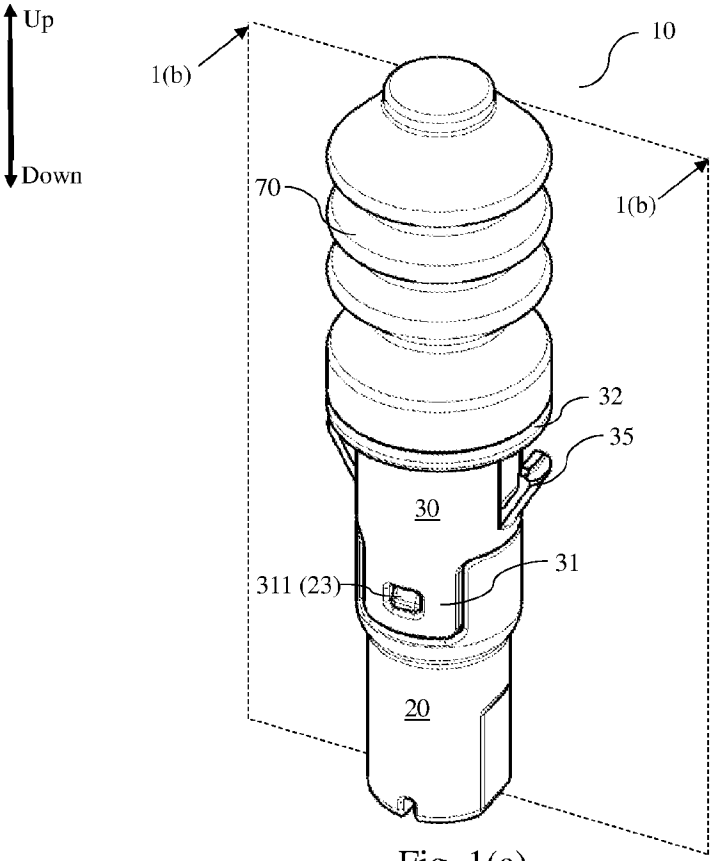

The push lifter 10 according to the embodiment of the present invention includes a body portion (hereinafter "case") 20, a cap portion 30, a rod 40, a rotator 50, an urging portion (hereinafter "spring") 60, and a boot 70 as shown in FIGS. 1(*a*), 1(*b*).

The case 20 is described in details in FIGS. 1(*a*)-3.

The case 20 is formed in a tubular shape, wherein an outer diameter of the case 20 is less than a diameter of the attachment hole H of the inner panel P to pass through the attachment hole H penetrating through the front and back surfaces FS, BS of the inner panel P of the auto vehicle as shown in FIGS. 2(*a*), 2(*b*). As shown in FIG. 1(*b*), a lower end of the case 20 is closed and an upper end of the case 20 is open. The spring 60 is housed inside the case 20 and arranged between the lower end and the rod 40 to urge the rod 40 in a direction away from the lower end of the case 20 toward the upper end of the case 20. The case 20 includes a cap attachment portion 22 and a pair of protrusions 23.

Figure 3:
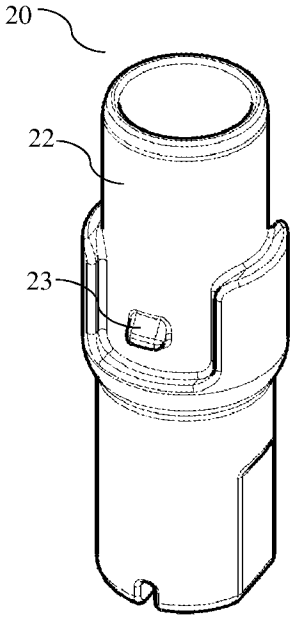
FIG. 3 is a perspective view of a case of the push lifter according to the present embodiment.

As shown in FIG. 3, the cap attachment portion 22 is a concave portion formed around an outer circumferential wall at the upper end of the case 20 for attaching the cap portion 30. The cap attachment portion 22 has an outer circumference such that an outer circumference of the cap portion 30 aligns with the circumference of the case 20 when the cap portion 30 is mounted over the cap attachment portion 22 as shown in FIGS. 1(*a*), 1(*b*).

As shown in FIG. 3, the pair of protrusions 23 protrudes outwardly from the cap attachment portion 22 at positions opposite to each other in respect to an axis of the case 20. Each protrusion 23 has an inclined surface in which the surface gradually inclines outwardly from an upper side toward a lower side so that a pair of attaching pieces 31 of the cap portion 30 slides over the corresponding inclined surfaces and attaches the cap portion 30 to the case 20 by engaging the pair of protrusions 23 with a pair of through holes 311 of the cap portion 30 shown in FIG. 1(*a*).

The cap portion 30 is described in details in FIGS. 1(*a*)-2(*b*), and 4(*a*)-4(*c*).

Figure 4C:
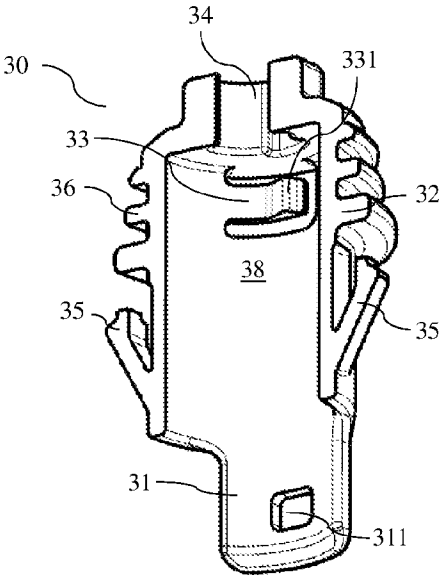
FIGS. 4(*a*)-4(*c*) illustrate a cap portion of the push lifter according to the present embodiment, wherein FIG. 4(*a*) is a perspective view thereof, FIG. 4(*b*) is a cross-sectional view along plane 4(*b*)-4(*b*) in FIG. 4(*a*), and FIG. 4(*c*) is another cross-sectional view along plane 4(*b*)-4(*b*) in FIG. 4(*a*) viewed from a different angle.
Figure 4B:
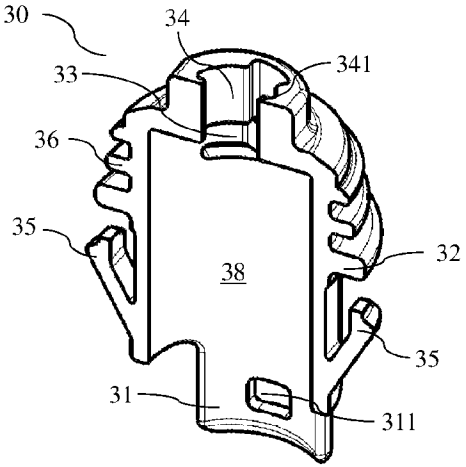
Figure 4A:
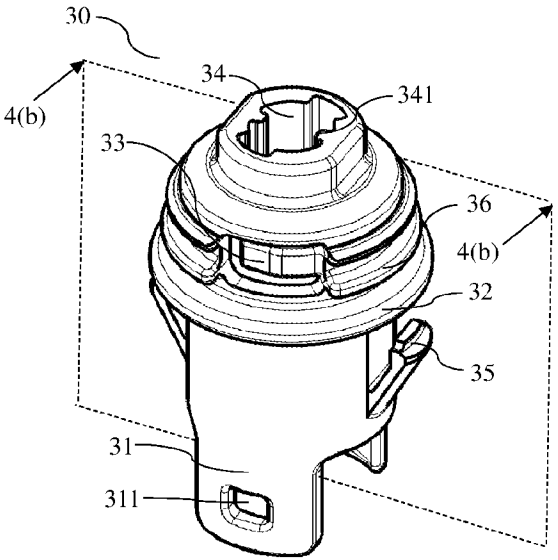
Figure 6A:
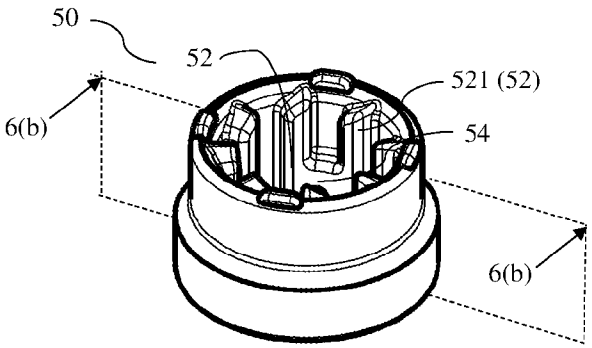
FIGS. 6(*a*), 6(*b*) illustrate a rotator of the push lifter according to the present embodiment, wherein FIG. 6(*a*) is a perspective view thereof and FIG. 6(*b*) is a cross-sectional view along plane 6(*b*)-6(*b*) in FIG. 6(*a*).
Figure 6B:
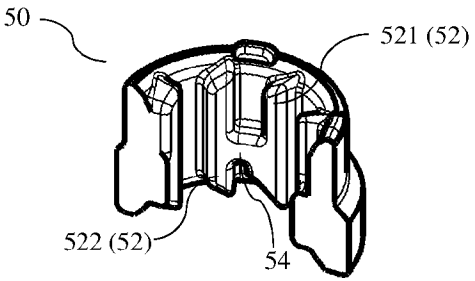

As shown in FIGS. 1(*a*), 1(*b*), the cap portion 30 is formed in a tubular shape wherein a lower end thereof is mounted over the cap attachment portion 22 at the upper end of the case 20 to attach the cap portion 30 to the case 20. As shown in FIGS. 4(*a*)-4(*c*), the cap portion 30 includes the pair of attaching pieces 31, a flange portion 32, a pair of elastic pieces 33, a through-hole 34, a pair of elastic claws 35, a boot attachment portion 36, and a cam housing portion 38.

The pair of attaching pieces 31 each including the through-hole 311 extends from the lower end of the cap portion 30 as shown in FIGS. 4(*a*)-4(*c*). Each of the attaching pieces 31 slides over the respective protrusion 23 of the case 20, and the cap portion 30 is attached to the case 20 through engagements between the through holes 311 and the protrusions 23 as shown in FIG. 1(*a*).

The flange portion 32 is formed on an upper side of the pair of attaching pieces 31. An upper surface of the flange portion 32 contacts a lower surface of the boot 70 to support the boot 70 when the user presses down on the push lifter 10 as shown in FIG. 2(*b*). A lower surface of the flange portion 32 abuts against a front surface FS of the inner panel P so that the inner panel P is sandwiched between the flange portion 32 and the elastic claws 35, and the push lifter 10 is attached to the inner panel P of the auto vehicle.

The pair of elastic pieces 33 is formed on a sidewall of the cap portion 30 by cutting out three cutouts connected to each other to form a C-shape cutout and having one end connected to the sidewall of the cap portion 30 as shown in FIGS. 4(*a*)-4(*c*). The pair of elastic pieces 33 extends in the circumferential direction between the upper end of the cap portion 30 and the flange portion 32. The elastic piece 33 has a tension leg 331 at a free end thereof protruding toward the rotator 50 to slide along an outer circumferential surface of the rotator 50 as shown in FIG. 4(*c*). The tension leg 331 urges the rotator 50 radially inwardly to support the rotator 50 in a radial direction.

The through-hole 34 penetrates vertically to slidably receive the rod 40 at an upper end of the cap portion 30. As shown in FIG. 4(*a*), the through-hole 34 has a shape corresponding to a cross-sectional shape of the rod 40, and includes a pair of locking protrusions 341 protruding radially inwardly toward a center of the through-hole 34. The pair of locking protrusions 341 is formed to correspond to vertical grooves 41 of the rod 40 and guides the rod 40 when the rod 40 is moving vertically.

The boot attachment portion 36 is formed on the outer circumferential surface between the upper end of the cap portion 30 and the flange portion 32 in an axial direction. The boot attachment portion 36 protrudes radially outwardly to attach the boot 70 to be described later.

The cam housing portion 38 is a space formed below the through-hole 34 inside the cap portion 30 communicating with the through-hole 34. The cam housing portion is formed for housing the cam portion 50.

The pair of elastic claws 35 is formed on the outer circumferential surface between the flange portion 32 and attaching pieces 31. The pair of elastic claws 35 has a lower end connected to the cap portion 30 and a free end at the upper side, and gradually protrudes radially outwardly from the lower side toward the upper side to be capable of elastically deforming. When the cap portion 30 is fitted into the attachment hole H as shown in FIGS. 2(*a*), 2(*b*), the pair of elastic claws 35 recedes to pass through the attachment hole H and elastically returns at the back surface BS of the inner panel P. The inner panel P is clamped between the pair of elastic claws 35 and the flange portion 32 of the cap portion 30, thereby, the push lifter 10 is attached to the inner panel P of the auto vehicle.

The rod 40 is described in details in FIGS. 1(*b*), 5(*a*), and 5 (*b*).

Figure 5B:
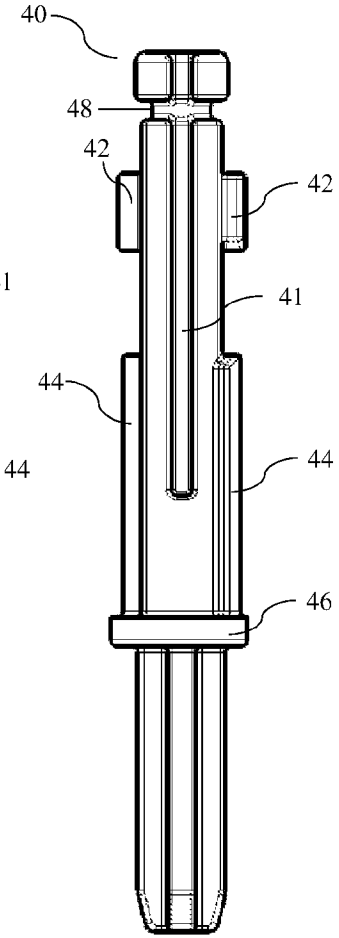
FIGS. 5(*a*), 5(*b*) illustrate a rod of the push lifter according to the present embodiment wherein FIG. 5(*a*) is a perspective view thereof and FIG. 5(*b*) is a side view thereof.
Figure 5A:
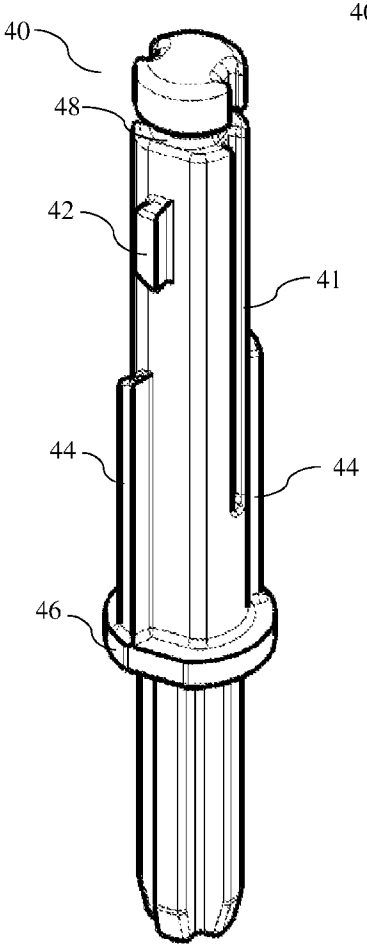

As shown in FIG. 1(*b*), the rod 40 is slidably held inside the case 20, and protrudes from the inside of the case 20 through the cap portion 30 so as to push out the fuel lid. The rod 40 includes a first rib portion 42, a second rib portion 44, a flange portion 46, an annular groove 48, and a pair of vertical grooves 41, as shown in FIGS. 5(*a*), 5(*b*).

The first rib portion 42 is a protrusion protruding from an outer circumferential surface of the rod 40 and extending in the axial direction. The first rib portion 42 has a lower end abutting against an inner cam portion of the rotator 50 described later to rotate the rotator 50 and lock or unlock the rod 40. The first rib portion 42 is formed at an intermediate portion of the rod 40 in the axial direction.

The second rib portion 44 is a protrusion protruding from the outer circumferential surface of the rod 40 and extending in the axial direction. The second rib portion 44 has an upper end abutting against an inner cam portion of the rotator 50 to rotate the rotator 50 and lock or unlock the rod 40. The second rib portion 44 is formed below the first rib portion 42 at a position distanced from the first rib portion 42 in the axial direction. More specifically, in the present embodiment, a distance between the lower end of the first rib portion 42 and the upper end of the second rib portion 44 is equivalent to or greater than a length of the rotator 50 in the axial direction. Further, the second rib portion 44 is formed at a position deviating from the first rib portion 42 in the circumferential direction. More specifically, the second rib portion 44 is positioned adjacent to the first rib portion 42 in the circumferential direction, wherein the first rib portion 42 and the second rib portion 44 do not overlap each other in the axial direction.

The flange portion 46 protrudes radially outwardly from the outer circumferential surface below the second rib portion 44. The flange portion 46 has an upper surface facing the rotator 50 and a lower surface to receive the spring 60 thereunder. Further, the lower surface of the flange portion 46 is connected to the second rib portion 44 so that the second rib portion 44 supports the flange portion 46 in the axial direction when the rod 40 is sliding against the urging portion 60, and vice-versa, the flange portion 46 supports the second rib portion 44 in the axial direction when the second rib portion 44 abuts against the inner cam portion of the rotator 50.

The annular groove 48 is formed at an upper end portion of the rod 40 to which the boot 70 is attached.

The pair of vertical grooves 41 is formed on the outer circumferential surface extending in the axial direction of the rod 40 between the annular groove 48 and the flange portion 46, and between the pair of first rib portions 42 and the pair of second rib portions 44 in a circumferential direction of the rod 40. More specifically, the vertical groove 41 is formed from an edge of the annular groove 48 and ends between the upper end of the second rib portion 44 and the flange portion 46 so that the locking protrusion 341 of the cap portion 30 abuts against the lower end of the vertical groove 41 to prevent the rod 40 from sliding out of the body portion 20. Thus, the lower end of the vertical groove 41 is abutting against the locking protrusion 341 when the fuel lid is open.

The rotator 50 is described in details in FIGS. 1(*b*), 6(*a*), and 6(*b*).

The rotator 50 is disposed rotatably about an axis of the rod 40 at the one end of the case 20 to lock or unlock the rod 40. The rotator includes an inner cam portion having a plurality of teeth 52 and a plurality of connecting pieces 54.

The plurality of teeth 52 extends in the axial direction. Each of the plurality of teeth 52 has a first end 521 to abut against the first rib portion 42 to rotate the rotator 50 and a second end 522 opposite to the first end 521 to abut against the second rib portion 44 to rotate the rotator 50.

The plurality of connecting pieces 54 is disposed alternately between the teeth 52 and extending in a circumferential direction of the rotator 40 to connect the plurality of teeth 52 at a position between the first end 521 and second end 522. The rod 40 is locked when the second rib portion 44 abuts against the connecting piece 54 between the plurality of teeth 52.

The spring 60 is described in details in FIG. 1(*b*).

The spring 60 is disposed inside the case 20 to urge the rod 40 in a direction away from the case 20. The spring 60 is compressed between the bottom end of the case 20 and the flange portion 46 of the rod 40 and urges the rod 40 toward a direction protruding from the inside of the case 20.

The boot 70 is described in details in FIG. 1(*b*).

The boot 70 is elastic and attached to the cap portion 30 to cover the upper end of the rod 40 protruding from the case 20 and the cap portion 30. The boot 70 is formed in a hollow bellows shape in which a lower end is open, and an upper end is closed. The boot 70 includes an annular protrusion 72 and an annular convex portion 74.

The annular protrusion 72 is formed on an inner circumferential surface of the upper end of the boot 70. The annular protrusion 72 protrudes annularly inwardly to fit in the annular groove 48 of the rod 40.

The annular convex portion 74 is formed on the inner circumferential surface of the lower end of the boot 70. The annular convex portion 74 protrudes annularly inwardly to fit in the boot attachment portion 36 of the cap portion 30.

Figures 7A, 7B, 7C, 7D, 7E:
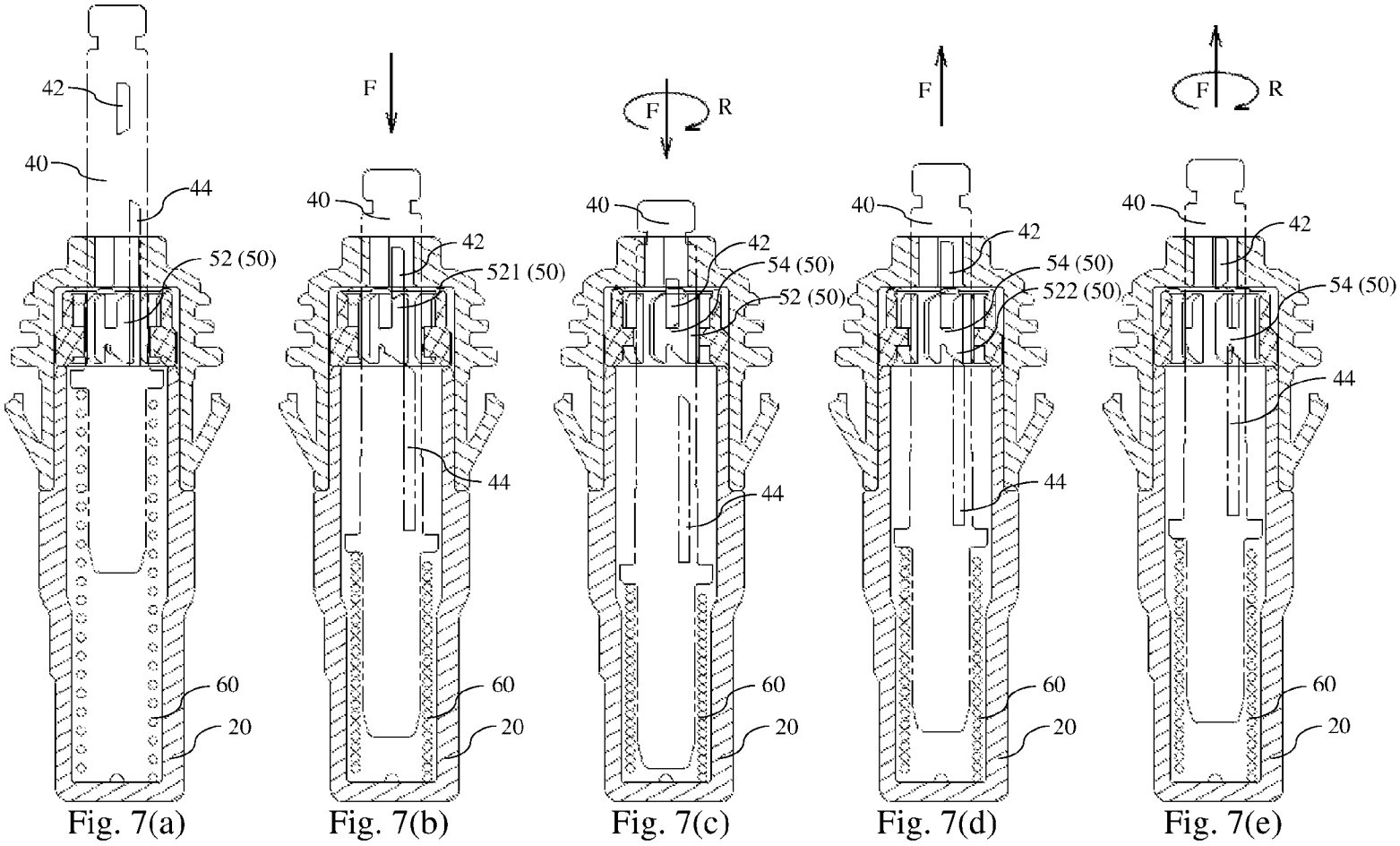
FIGS. 7(*a*)-7(*e*) are explanatory drawings illustrating an operation of locking the rod of the push lifter according to the present embodiment.

Next, the operation of the push lifter of the present embodiment is explained in details in FIGS. 7(*a*)-8(*e*).

In the open state of the fuel lid as shown in FIG. 7(*a*), the spring 60 is urging the rod 40 away from the case 20. The lower end of the vertical groove 41 of the rod 40 is abutting against the locking protrusion 341 of the cap portion 30, and the second rib portion 44 is arranged between the plurality of teeth 52.

As shown in FIG. 7(*b*), when the user presses the fuel lid downwardly as indicated by the arrow F against the urging force of the spring 60, the second rib portion 44 slides downward along with the rod 40 through the plurality of teeth 52 and the first rib portion 42 simultaneously slides downward along with the rod 40 to abut against the first end 521 of teeth 52.

As shown in FIG. 7(*c*), the rod 40 is further pressed downwardly as indicated by the arrow F, and the rotator 50 is rotated in the direction as indicated by the arrow R by the abutment between the first rib portion 42 and the first end 521 of teeth 52, and the first rib portion 42 abuts against the connecting piece 54 between the plurality of teeth 52 and prevents the rod 40 from sliding further downward.

Then, when the user releases the fuel lid, the spring 60 urges the rod 40 upwardly toward the fuel lid as indicated by the arrow F in FIG. 7(*d*). The first rib portion 42 slides upwardly away from the connecting piece 54 and the second rib portion 44 slides upwardly toward the rotator 50 to abut against the second end 522 of the teeth 52.

As shown in FIG. 7(*e*), the second rib portion 44 is further urged upwardly by the spring 60 as indicated by the arrow F, and the rotator 50 is rotated in the direction as indicated by the arrow R by the abutment between the second rib portion 44 and the second end 522, and the second rib portion 44 slides between the plurality of teeth 52 to abut against the connecting piece 54. The rod 40 is locked to the rotator 50 and the fuel lid is in the closed state.

Figures 8A, 8B, 8C, 8D, 8E:
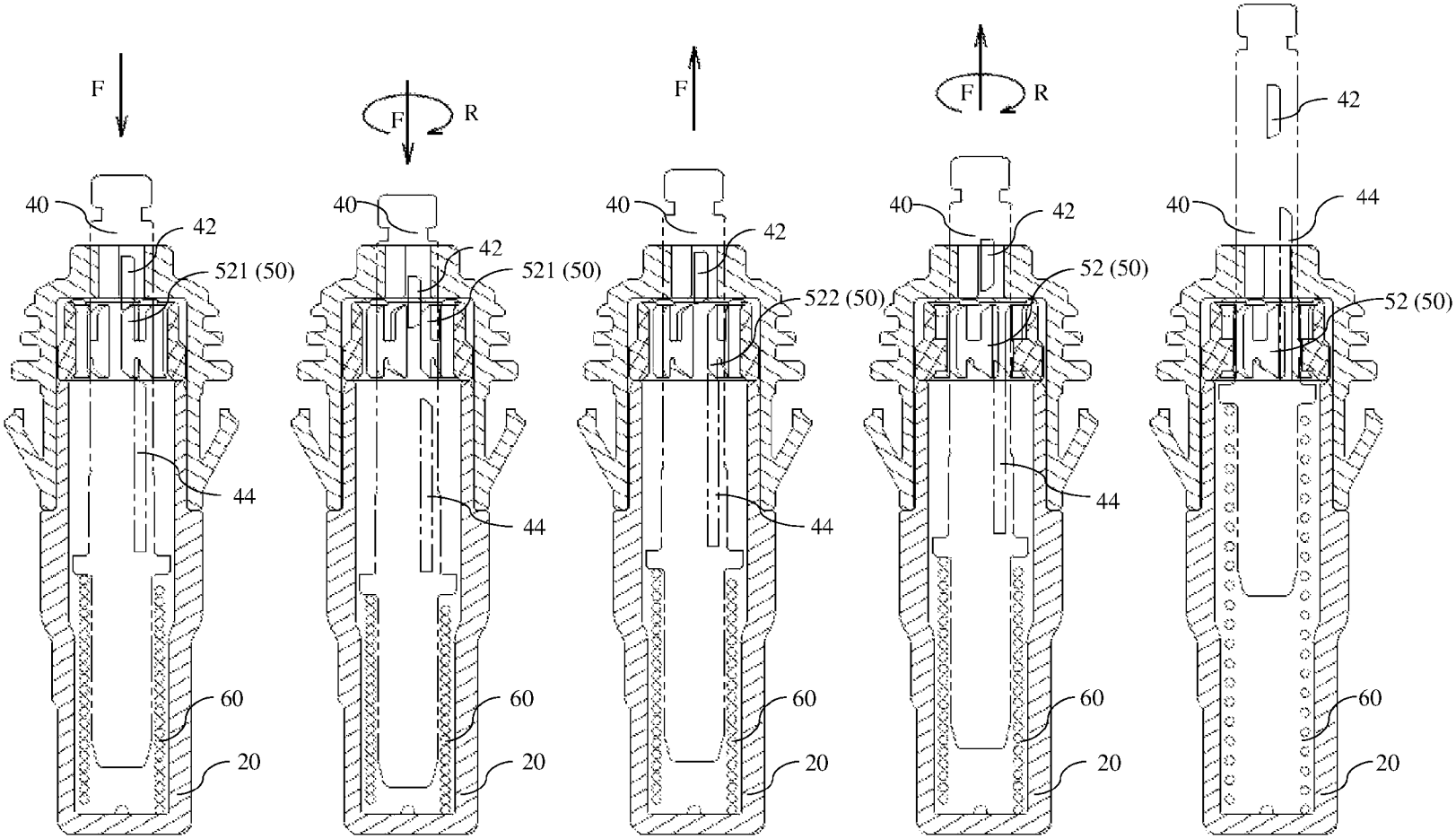
FIGS. 8(*a*)-8(*e*) are explanatory drawings illustrating an operation of unlocking the rod of the push lifter according to the present embodiment.
Figure 9F:
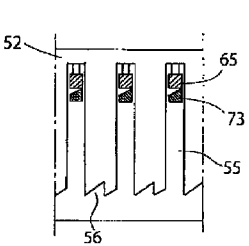
Fig. 9(f) Prior Art
FIGS. 9(*a*)-9(*f*) illustrate a conventional push lifter, wherein FIG. 9(*a*) is a cross-sectional view thereof and FIGS. 9(*b*)-9(*f*) show a locking mechanism thereof.
Figure 9D:
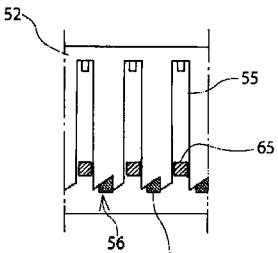
Fig. 9(d) Prior Art
Figure 9E:
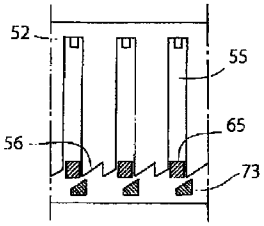
Fig. 9(e) Prior Art
Figure 9C:
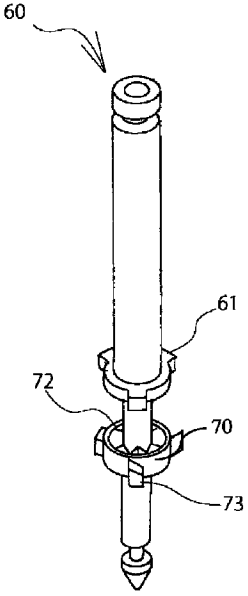
Fig. 9(c) Prior Art
Figure 9B:
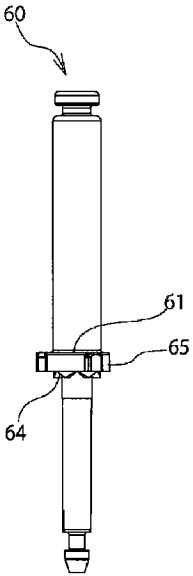
Fig. 9(b) Prior Art
Figure 9A:
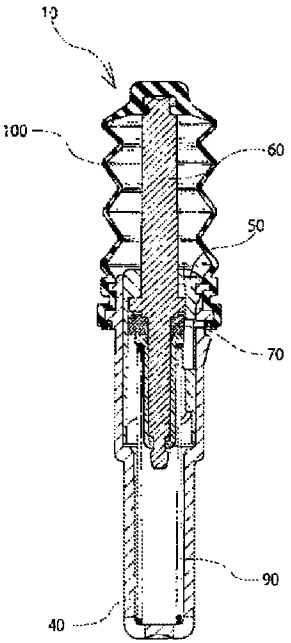
Fig. 9(a) Prior Art
Figure 10B:
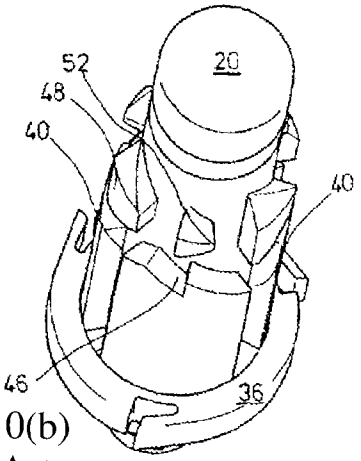
Fig. 10(b) Prior Art
FIGS. 10(*a*)-10(*c*) illustrate another conventional push lifter, wherein FIG. 10(*a*) is a cross-sectional view thereof and FIGS. 10(*b*), 10(*c*) show a locking mechanism thereof.
Figure 10C:
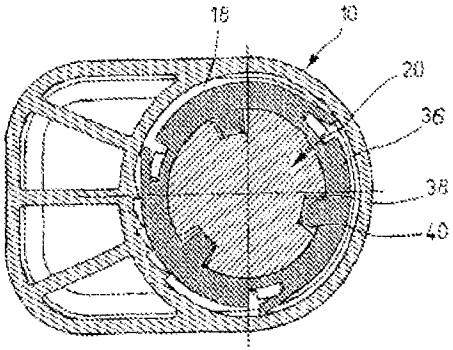
Fig. 10(c) Prior Art
Figure 10A:
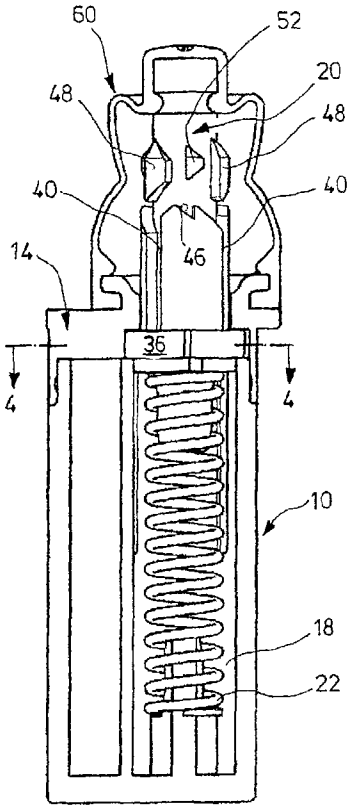
Fig. 10(a) Prior Art

Conversely, to open the fuel lid in the closed state shown in FIG. 7(*e*), the user presses the fuel lid downwardly as indicated by the arrow F in FIG. 8(*a*) against the urging force of the spring 60. The second rib portion 44 slides downward away from the connecting piece 54 and the first rib portion 42 simultaneously slides downward along with the rod 40 to abut against the first end 521 of teeth 52.

As shown in FIG. 8(*b*), the rod 40 is further pressed downwardly as indicated by the arrow F, and the rotator 50 is rotated in the direction as indicated by the arrow R by the abutment between the first rib portion 42 and the first end 521 of teeth 52, and the first rib portion 42 slides between the plurality of teeth 52.

Then, when the user releases the fuel lid, the spring 60 urges the rod 40 upwardly toward the fuel lid as indicated by the arrow F in FIG. 8(*c*). The first rib portion 42 slides upwardly away from the position between the plurality of teeth and the second rib portion 44 slides upwardly toward the rotator 50 to abut against the second end 522 of the teeth 52.

As shown in FIG. 8(*d*), the second rib portion 44 is further urged upwardly by the spring 60 as indicated by the arrow F, and the rotator 50 is rotated in the direction as indicated by the arrow R by the abutment between the second rib portion 44 and the second end 522.

As shown in FIG. 8(*e*), the second rib portion 44 slides through the rotator 50 between the plurality of teeth 52. The lower end of the vertical groove 41 of the rod 40 (not shown) abuts against the locking protrusion 341 of the cap portion 30 (not shown), and the fuel lid is in the open state.

Accordingly, the rotator 50 rotates according to the movement of the rod 40. The first and second rib portions 42, 44 assure locking and unlocking of the rod 40 to the rotator. The fuel lid is open and closed accordingly while the level of sound is reduced and the strength of the engaging parts between the rod and the rotator is increased to increase the tolerance against damage.

The above description simply illustrates the principle of the invention. Furthermore, a great number of modifications and alterations are possible for those skilled in the art, and the invention not being limited to the heretofore illustrated and described exact configurations and applications, all corresponding modification examples and equivalents are deemed to be within the scope of the invention defined by the attached claims and their equivalents.

What is claimed is:

1. A push lifter comprising:

a body portion adapted to be fixed to a member;

a rod slidably disposed inside the body portion and protruding from one end of the body portion, the rod having a first rib portion and a second rib portion distanced from the first rib portion in an axial direction of the rod;

an urging portion disposed inside the body portion to urge the rod in a direction away from the body portion; and a rotator disposed rotatably about the rod at the one end of the body portion and including a plurality of teeth extending in the axial direction on an inner circumferential surface thereof and a plurality of connecting pieces disposed alternately between the teeth and extending in a circumferential direction of the rod to connect the plurality of teeth, the rod being locked when the second rib portion abuts against the connecting piece between the plurality of teeth, wherein the plurality of teeth each includes a first end to abut against the first rib portion to rotate the rotator when the rod is pressed to slide inwardly of the body portion and a second end opposite to the first end to abut against the second rib portion to rotate the rotator when the rod is released to project outwardly from the body portion.

2. The push lifter according to claim 1, wherein the second rib portion is positioned to deviate from the first rib portion in the circumferential direction so that when the rod is pressed to the body portion, the second rib portion slides along the rod away from a position between the plurality of teeth and the first rib portion slides along the rod to abut against the first end of teeth to rotate the rotator, and when the rod is released, the second rib portion slides toward the rotator to abut against the second end of the teeth, rotates the rotator, and slides between the plurality of teeth to abut against the connecting piece.

3. The push lifter according to claim 2, wherein the first end of each of the plurality of teeth has an inclined surface, the first rib portion has an inclined surface on one end facing the rotator to abut against the first ends of the plurality of teeth to rotate the rotator in one rotational direction, the second end of each of the plurality of teeth has an inclined surface, and the second rib portion has an inclined surface on one end facing the rotator to abut against the second ends of the plurality of teeth to rotate the rotator in the one rotational direction.

4. The push lifter according to claim 3, further comprising:

a cap portion mounted over the body portion to house the rotator;

wherein when the rod is pressed to slide toward the body portion, the rotator is rotated to lock or unlock the rod while being retained between the cap portion and the body portion.

5. The push lifter according to claim 4, wherein the cap portion further comprises a pair of elastic pieces formed on a sidewall thereof extending in the circumferential direction and each having a tension leg at a free end thereof protruding toward the rotator to slide along an outer circumferential surface of the rotator, the tension leg urging the rotator radially inwardly to support the rotator in a radial direction.

6. The push lifter according to claim 5, wherein the rod further comprises a flange portion disposed on a side opposite to the first rib portion with respect to the second rib portion, and having one surface facing the rotator and another surface opposite to the one surface to receive the urging portion thereunder.

* * * * *